US005337689A

United States Patent [19]

Tilders

[11] Patent Number: 5,337,689

[45] Date of Patent: Aug. 16, 1994

[54] FEED DOG MECHANISM FOR SEWING MACHINE

[75] Inventor: Benno V. Tilders, Waiblingen, Fed. Rep. of Germany

[73] Assignee: Union Special GmbH, Fed. Rep. of Germany

[21] Appl. No.: 74,118

[22] Filed: Jun. 8, 1993

[30] Foreign Application Priority Data

Jun. 19, 1992 [DE] Fed. Rep. of Germany ..... 4220008

[51] Int. Cl.[5] ..... D05B 27/08

[52] U.S. Cl. ..... 112/323

[58] Field of Search ..... 112/303, 312, 313, 314, 112/169, 323

[56] References Cited

U.S. PATENT DOCUMENTS

| | | | |
|---|---|---|---|
| 2,713,839 | 7/1955 | Engel | 112/323 |
| 3,472,188 | 10/1969 | Hayes | 112/323 |
| 4,295,434 | 10/1981 | Hsiao | 112/323 X |
| 4,505,213 | 3/1985 | Killinger | 112/169 X |
| 4,624,202 | 11/1986 | Alberti et al. | 112/323 X |
| 4,674,426 | 6/1987 | Kasuda et al. | 112/313 |
| 5,103,751 | 4/1992 | Wang | 112/314 |

FOREIGN PATENT DOCUMENTS

| | | | |
|---|---|---|---|
| 2295590 | 12/1990 | Japan | 112/324 |

*Primary Examiner*—Clifford D. Crowder
*Assistant Examiner*—Ismael Izaguirre
*Attorney, Agent, or Firm*—Willian Brinks Hofer Gilson & Lione

[57] ABSTRACT

A sewing machine having a device feed dog (21) is disposed in a drive arrangement with a rotating main shaft (5). A lift eccentric (17) provides the feed device with the lift movement by means of an auxiliary carrier (43) and a feed drive (8) provides the feed dog (21) with the feed movement (FIG. 1). The device can alternatively be formed as a differential feed device (FIG. 6).

19 Claims, 10 Drawing Sheets

FEED DOG MECHANISM FOR SEWING MACHINE

BACKGROUND OF THE INVENTION

1. Field of the Invention

The invention relates to a sewing machine having a workpiece feed device having a feed dog which performs a lift and feed movement.

2. Background Information

A sewing machine is known from U.S. Pat. No. 4,674,426, wherein a rotating main shaft initiates the lift movement of a feed device and a pivotally driven oscillating shaft initiates the feed movement. In this case, a feed locus or orbit in the form of an ellipse flattened on one side, similar to the shape of an egg, is produced by reason of the described direct coupling of the oscillating shaft to the lift drive of the feed device. The feed locus or orbit does in fact render it possible to provide the feed drive with a transmission which is of a simple construction, but it does not allow for an optimum design of the vertical components of the feed locus or orbit, e.g. in an elliptical form.

An object of the invention is to develop further a workpiece feed device, in such a way that an optimum design of the vertical components of the feed locus or orbit of the feed dog and/or the feed device is possible.

SUMMARY OF THE INVENTION

The present invention resides in a sewing machine having a workpiece feed device which performs a lift and feed movement and comprises at least one feed dog, a rotatable main shaft having a lift eccentric, at least one feed drive, at least one feed dog carrier which is disposed in a drive arrangement with the main shaft and the feed drive, the lift eccentric providing the feed dog carrier with the lift movement and the feed drive providing the feed dog carrier with the feed movement, and an auxiliary carrier, which is guided by a vertical guide and extends substantially perpendicular to the feed direction, the main shaft likewise providing the auxiliary carrier with a lift movement by means of an auxiliary guide which transmits this lift movement to the feed dog carrier, by virtue of the vertical guide and by way of a further lift guide disposed at a spacing (A) with respect to the main shaft.

Accordingly, it is possible in a simple manner by means of the auxiliary carrier guided in the vertical guide to derive the vertical components of the feed locus or orbit of the feed dog and/or of the feed device exclusively from the lift movement of the eccentric of the main shaft and optimize these vertical components by way of the vertical guide. Consequently, the lift is not influenced by virtue of the feed drive and it is possible, for example, for the feed locus or orbit to be elliptical. In so doing, the lift guide attached at the spacing A with respect to the main shaft guarantees the parallelism of the lift movement of the auxiliary carrier and the feed dog carrier and the parts are prevented from rotating relative to each other and/or corresponding to the movement path predetermined by virtue of the form and position of the vertical guides.

BRIEF DESCRIPTION OF THE DRAWINGS

The invention is further described, by way of example, with reference to the accompanying drawings, in which.

DESCRIPTION OF THE PREFERRED EMBODIMENTS

Figure 1:
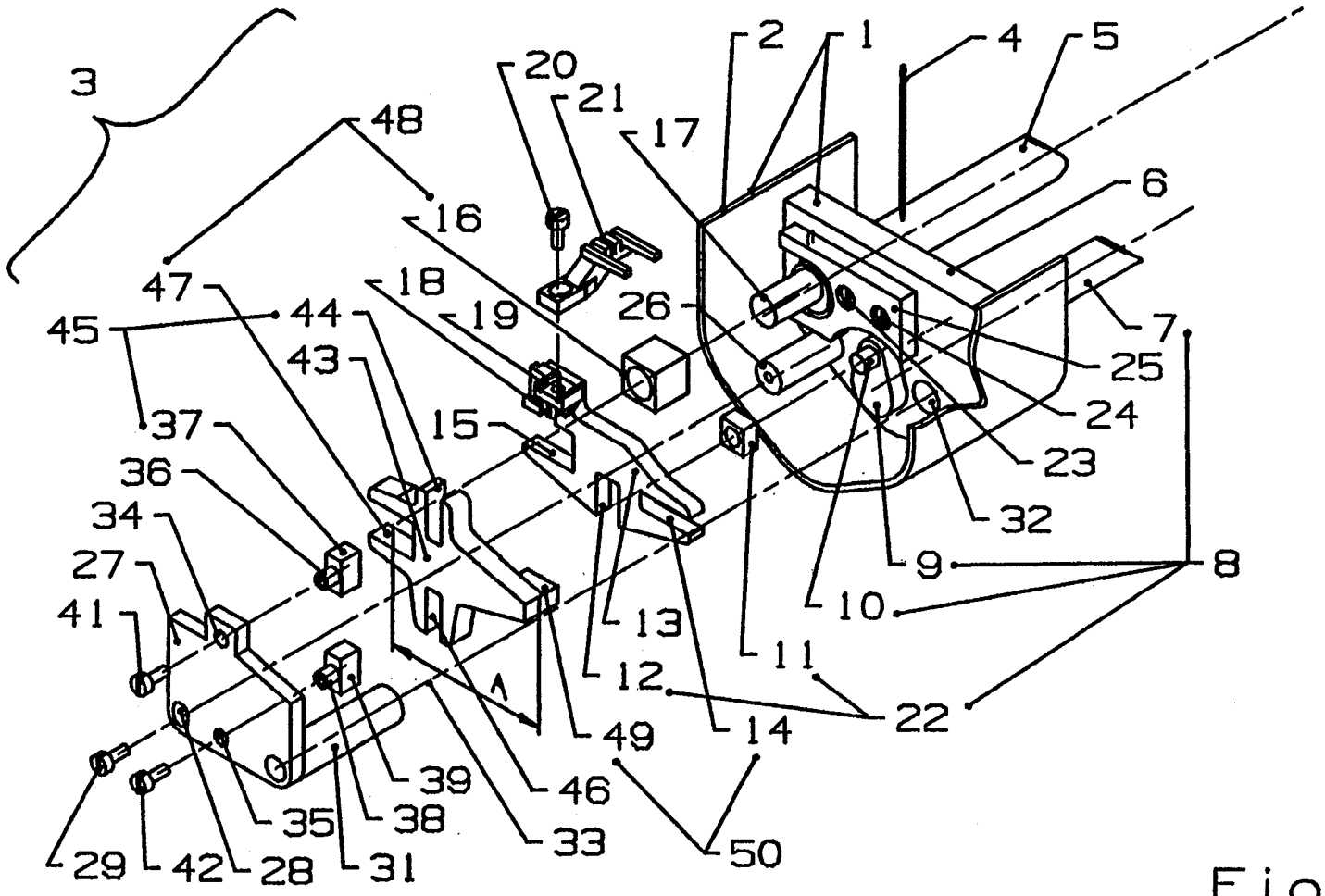
FIG. 1 is an exploded perspective view of a first embodiment of workpiece feed device in a fragmentary view of the sewing machine.

FIG. 1 illustrates a part of a sewing machine 1 having a cylinder arm 2 disposed at the lower part of the sewing machine 1, wherein a workpiece feed device 3 which performs a lift movement and feed movement is embedded or enclosed in the cylinder arm 2. A sewing machine needle 4 clarifies the illustration of the workpiece feed device, which is shown here as a one-way feed device. A rotating main shaft 5 is rotatably mounted in an intermediate plate 6 of the sewing machine 1 and is driven by means of a motor (not illustrated). An oscillating shaft 7 is part of a feed drive 8, which is drivingly connected by means of an intermediate transmission to the main shaft 5, and is mounted for oscillation in the intermediate plate 6. The oscillating shaft 7 is provided with a crank 9 having a crank pin 10 which supports a feed slide piece 11. The feed slide piece 11 protrudes into a feed opening in the form of a slot 12 of a feed dog carrier 13, which also has a lift opening in the form of a slot 14 and a further lift opening in the form of a slot 15. A lift slide piece 16 protrudes into the further lift slot 15 and is disposed about an eccentric pin 17 of the main shaft 5.

The feed dog carrier 13, also referred to as the feed plate carrier, supports an intermediate holder 19 which is attached by a screw 18 in a height adjustable manner and a feed dog 21 also referred to as a feed plate, is attached to the intermediate holder 19 by a screw 20 in a laterally adjustable manner. The feed slot 12 of the feed dog carrier 13 and the feed slide piece 11 are part of a feed drive connection 22. A counter guide plate 25 is attached to the intermediate plate 6 by each of two screws 23 and 24. A spacer pin 26 serves to attach a guide plate 27 which has an elongated hole 28 through which protrudes an attachment screw 29. A pivot pin 31 attached to the guide plate 27 protrudes into a housing opening 32 and enables the guide plate 27 to pivot about a pivot pin axis 33. The guide plate 27 is positioned radially by virtue of the screw 28 which protrudes into the elongated hole 28 and the screw 29 provides a screw connection for the guide plate 27 on the spaced pin 26. The guide plate 27 has a bore 34 and a bore 35, into which protrude respectively a pin 36 of a guide piece 27 and a pin 38 of a further guide piece 39. The guide pieces 37 and 39 are secured in an articulated manner by screws 41 and 42 respectively. The guide plate 27 and the guide plate 25, acting as a counter guide plate, serve as opposed supports for the carrier 13.

The guide piece 37 protrudes into a guide opening in the form of a slot 44 disposed on an auxiliary carrier 43 and the guide slot 44 arms with the guide piece 37 a vertical guide 45. The guide piece 39 protrudes into a guide opening in the form of a slot 46 and supports the vertical guide 45 of the auxiliary carrier 43. The lift slide piece 16 also protrudes into a lift opening in the form of a slot 47 of the auxiliary carrier 43 which forms with the lift slide piece 16 an auxiliary guide 48. A guide piece 49 is disposed on the auxiliary guide 48. A guide piece 49 is disposed on the auxiliary carrier 43 at a spacing A with respect to the main shaft 5 and the guide piece 49 engages in the lift slot 14 of the feed dog carrier 13 and formed with the lift slot a lift guide 50. This arrangement renders possible an optimum design of the vertical components of a feed locus or orbit 51, according to FIG. 8, of the feed dog 21 and/or feed devices described hereinunder.

Figure 2:
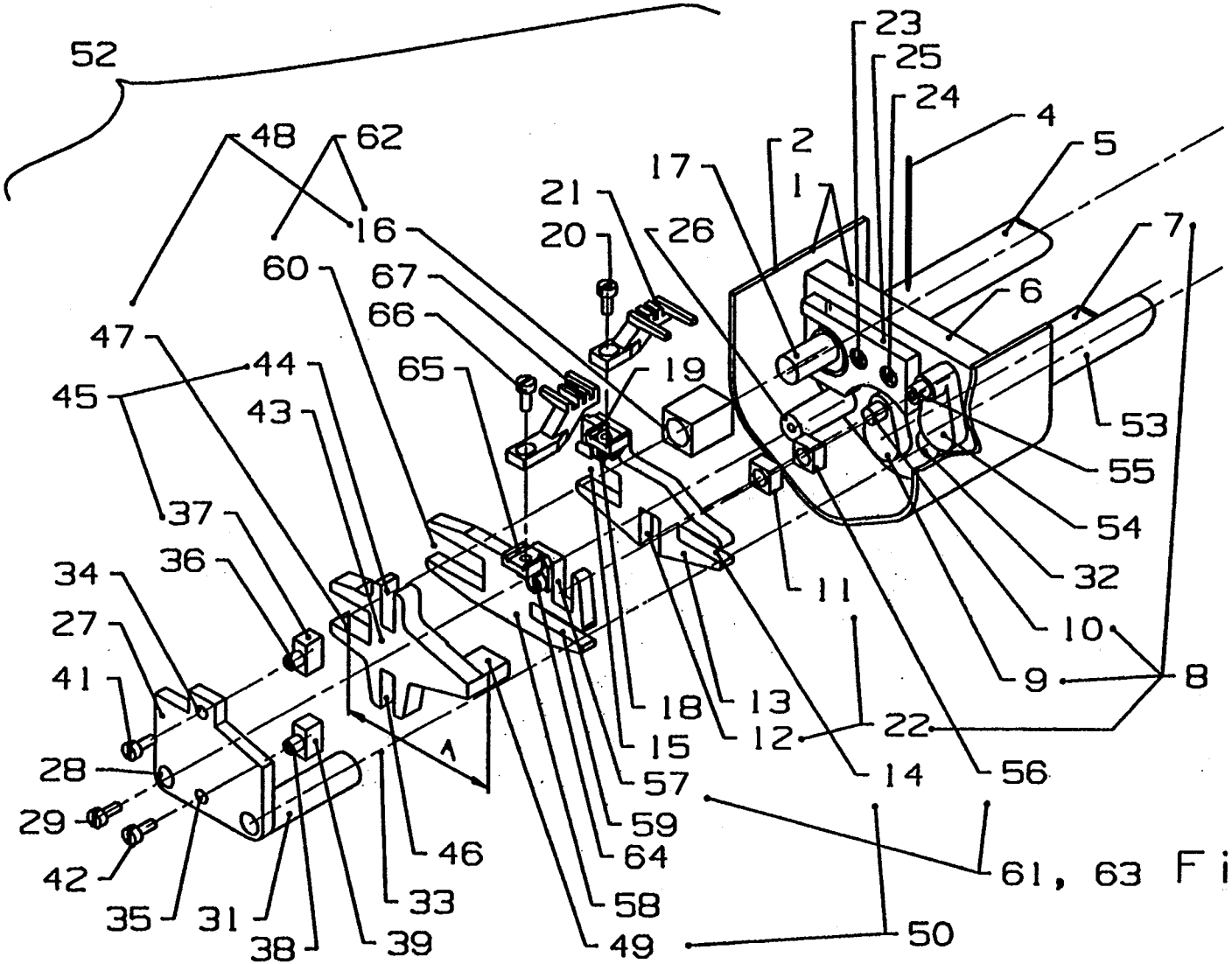
FIG. 2 is an exploded perspective view of a second embodiment of workpiece feed device in a fragmentary view of the sewing machine.

FIG. 2 illustrates a part of the sewing machine 1 having the cylinder arm 2 in which is embedded a second embodiment of workpiece feed device 52 which performs a lift movement and feed movement and the workpiece feed device 52 is also referred to as a differential feed device. Parts which have identical functions to those of FIG. 1, have identical designations.

An oscillatingly driven auxiliary shaft 53 is mounted in the intermediate plate 6. The auxiliary shaft 53 has a crank 54 with a crank pin 55 which embraces a further feed slide piece 56. The further feed slide piece 56 protrudes into a feed slot 57 of a further feed dog carrier 58 which has a lift slot 59 and a further lift slot 60, into which the lift slide piece 16 protrudes. The further feed slide piece 56 and the lift slot 57 are part of a further feed drive 61. The further lift slot 60 and the lift slide piece 16 are part of a lift drive connection 62; the lift slot 57 of the further feed dog carrier 58 and the further feed drive piece 56 are part of a feed drive connection 63. The feed drive is achieved by way of the auxiliary shaft 53 which is connected in a drive arrangement to the main shaft 5 by means of an intermediate transmission (not illustrated). The further feed dog carrier 58, also referred to as the differential feed plate carrier, supports a further intermediate holder 65 which is attached in a height adjustable manner by a screw 64 and an differential feed dog 67, also referred to as a differential feed plate, is attached to the intermediate holder 65 in a laterally adjustable manner by a screw 66. The guide piece 49 engages through the lift slot 59 into the lift slot 14 and causes the feed dog carriers 58 and 13 to be driven at the same time with the lift. The feed dog carrier 13 is disposed between the further carrier 58 and the guide plate 25 which thereby provide opposed supports for the feed dog carrier 13. The feed dog carrier 13 and the further carrier 58 are together disposed between the auxiliary carrier 43 and the guide plate 25 so as to be oppositely supported thereby.

Figure 3:
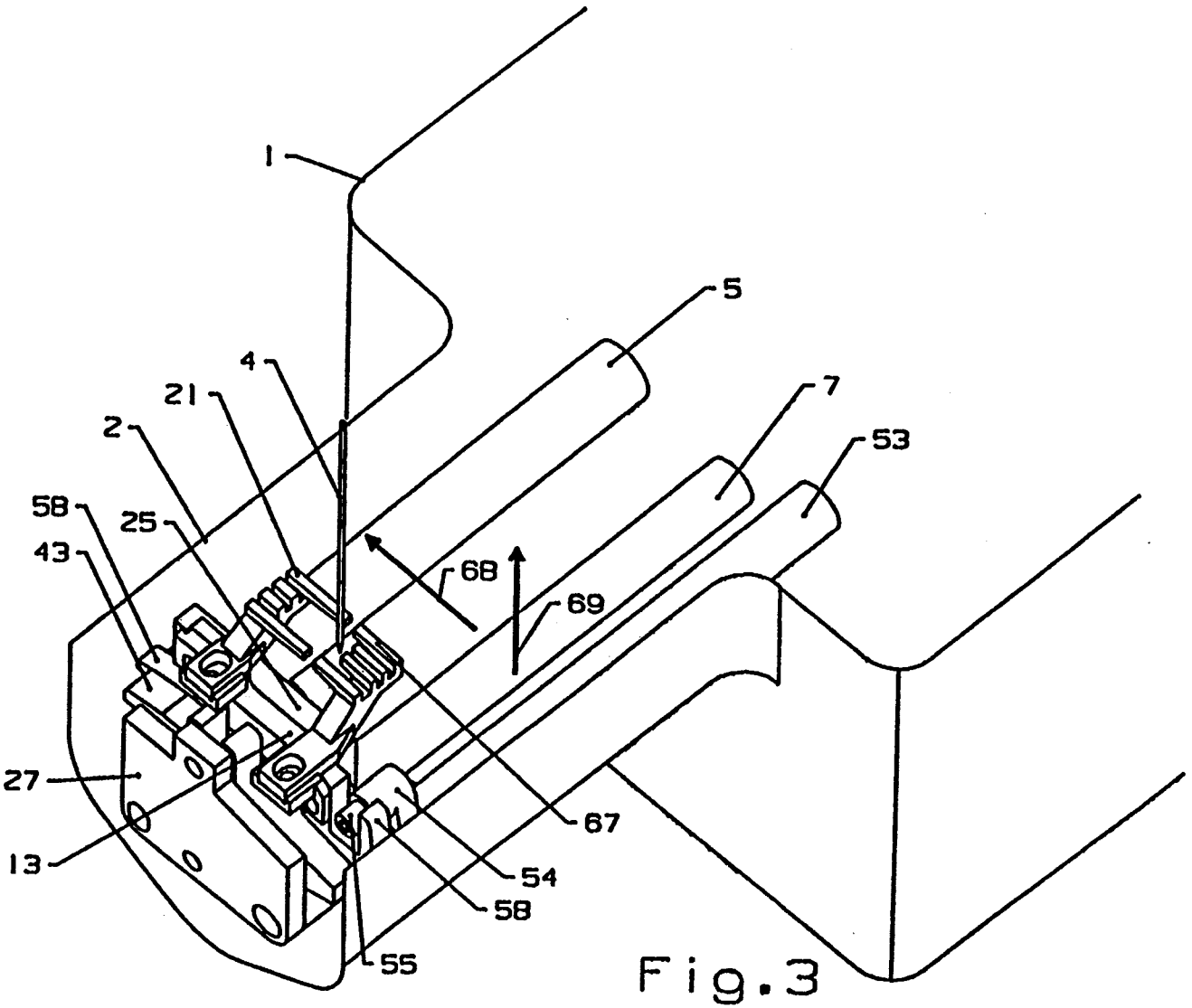
FIG. 3 is a perspective fragmentary illustration of the second workpiece feed device, embedded in a cylinder arm of a sewing machine housing.

FIG. 3 illustrates the compact design on the left-hand side of the needle 4 of the workpiece feed device, which is formed in this special case as a differential feed device. The arrows 68 and 69 characterize the feed and lift directions of the workpiece feed device and the feed dogs 21 and 67.

Figure 4:
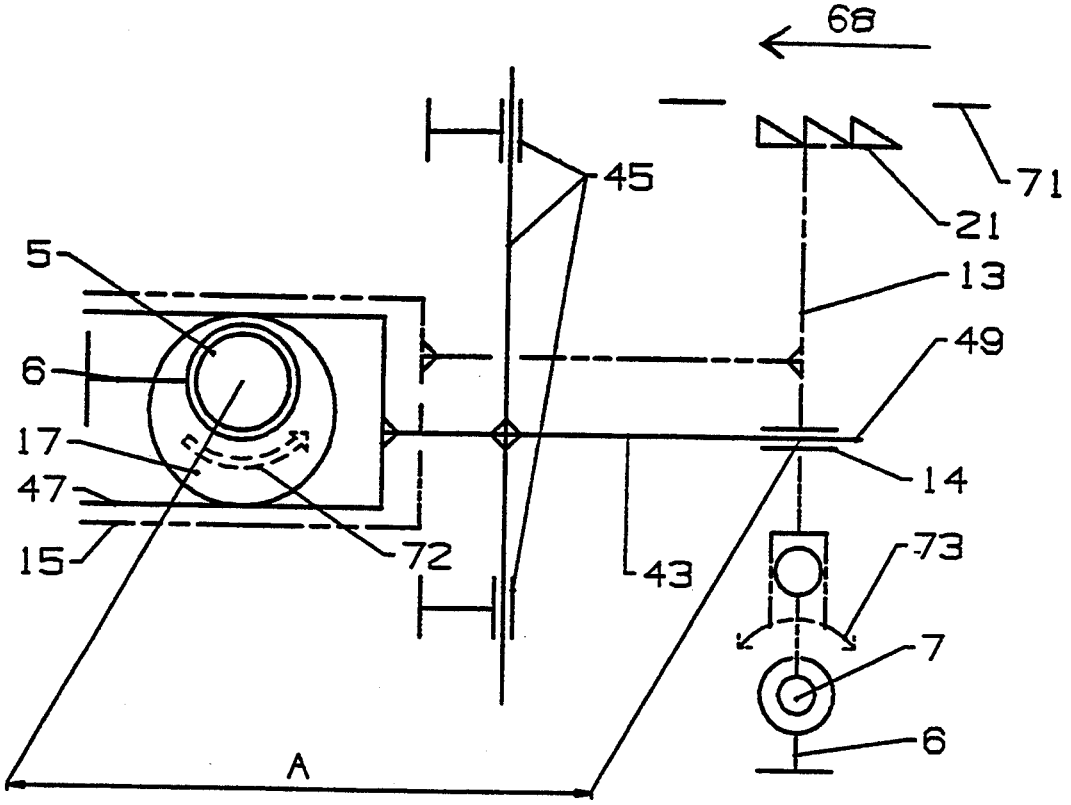
FIG. 4 is a schematic illustration of the first workpiece feed device, with the feed dog in the lowered position.
Figure 5:
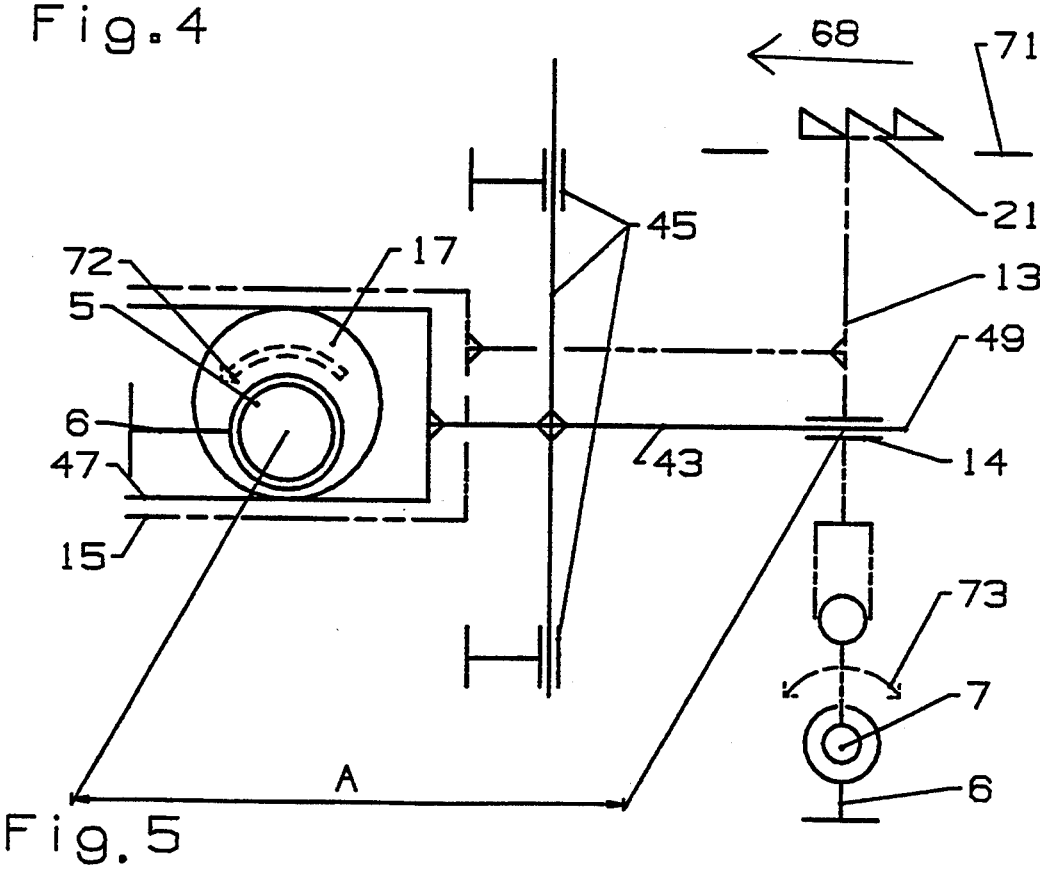
FIG. 5 is a schematic illustration of the first workpiece feed device, with the feed dog in the raised position.

FIGS. 4 and 5 illustrate a simple feed device with the feed dog in the lowered position and the feed dog in the raised position. These positions are clarified by means of a schematically illustrated hole plate 71. The schematically illustrated parts of the feed device bear the numerals as shown in FIG. 1. The arrow 72 illustrates a possible rotational direction of the eccentric 17, and double arrow 73 illustrates the pivot movement of the oscillating shaft 7.

Figure 6:
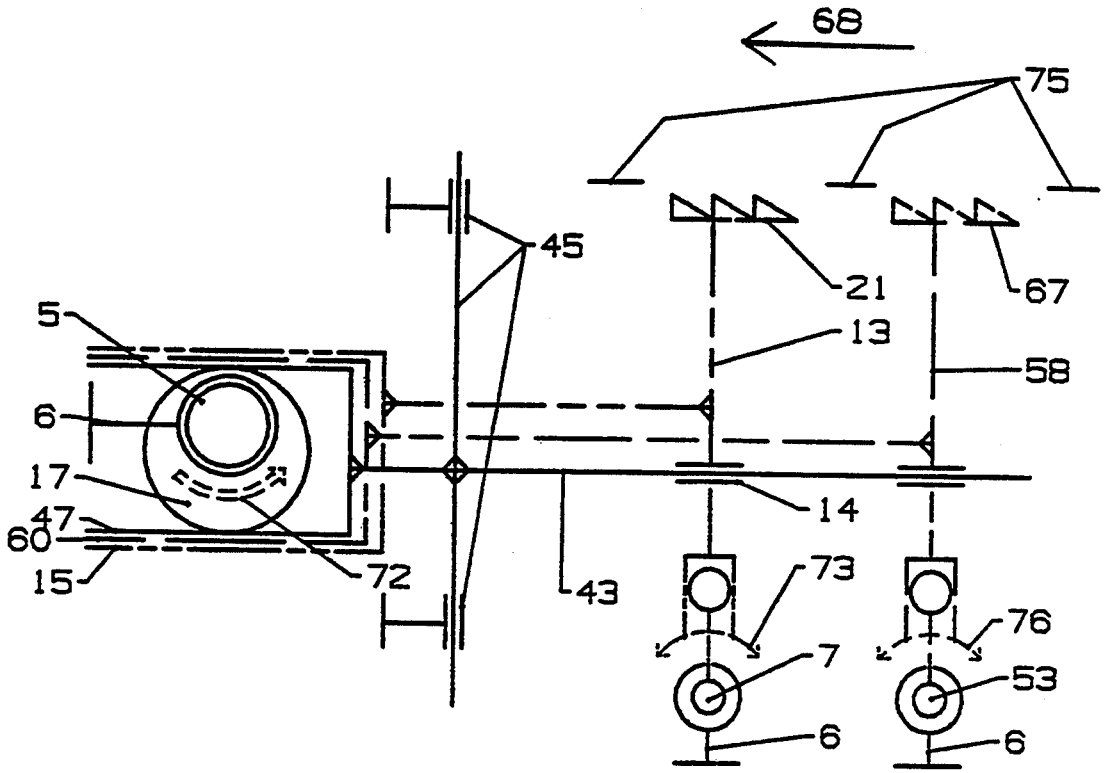
FIG. 6 is a schematic illustration of the second workpiece feed device, with the feed dog and differential feed dog in the lowered position.
Figure 7:
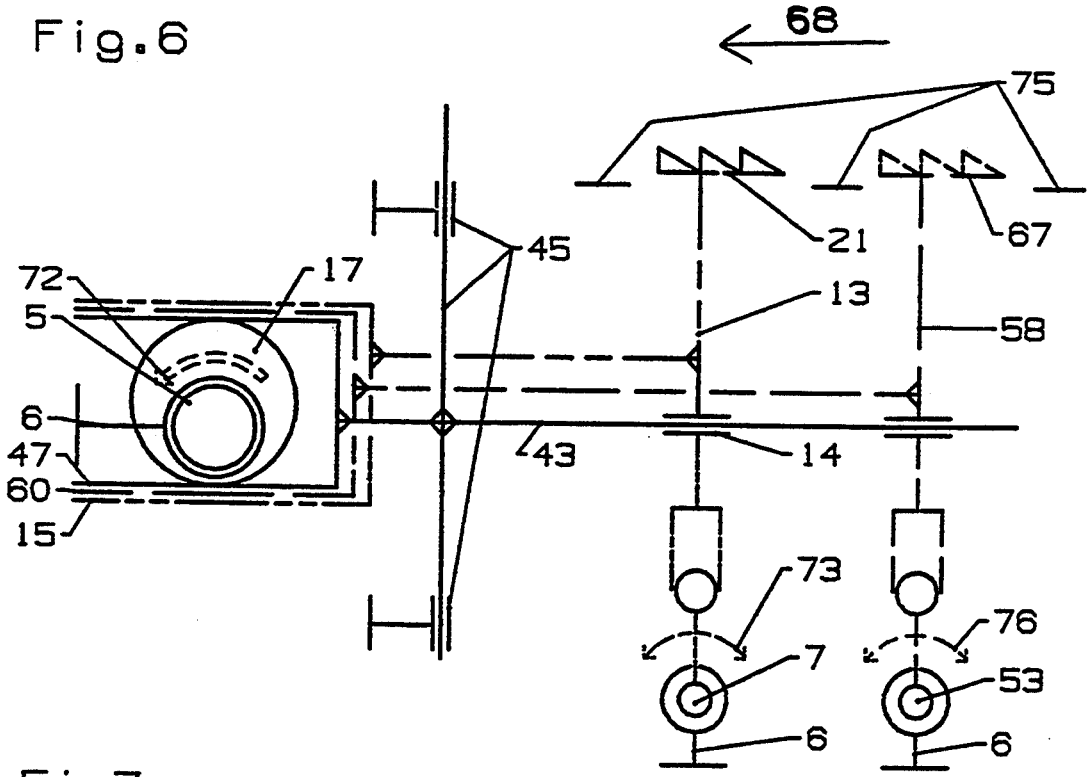
FIG. 7 is a schematic illustration of the second workpiece feed device, with the feed dog and differential feed dog in the raised position.

FIGS. 6 and 7 illustrate a differential feed device with the feed dog in the lowered position and the feed dog in the raised position. These positions are clarified by means of a schematically illustrated hole plate 75. The arrow 72 illustrates again a possible rotational direction of the eccentric pin 17, the double arrow 73 illustrates the pivot movement of the oscillating shaft 7 and the double arrow 26 illustrates the pivot movement of the auxiliary shaft 53.

Figure 8:
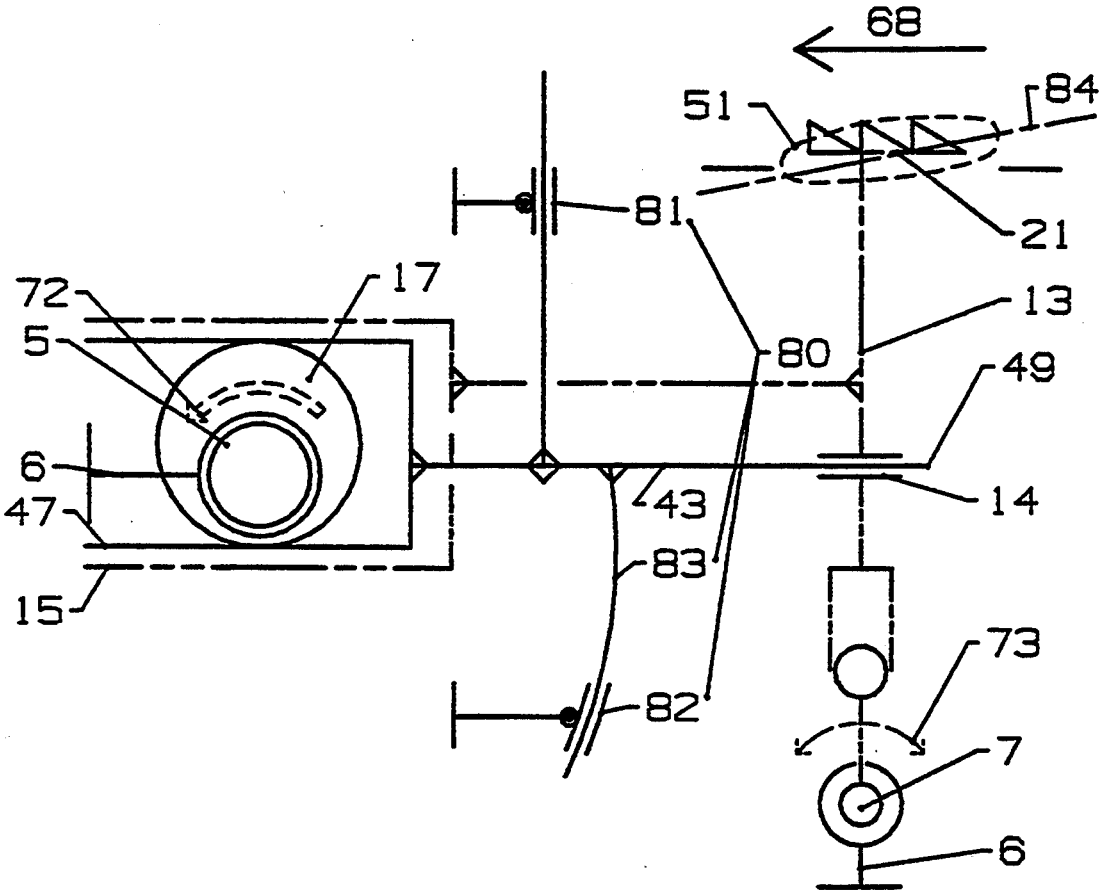
FIG. 8 is a schematic illustration of a third embodiment of workpiece feed device.

FIG. 8 schematically illustrates a third embodiment of the invention. In this case, a vertical guide 80 comprises the slide guides 81 and 82 which are disposed in an articulated manner extending substantially perpendicular to the feed direction 68. A desired inclination and/or distortion 84 of the approximately elliptical feed locus 51 of the feed dog 21 as shown in FIG. 1, or the approximately elliptical feed loci of the feed dogs 21 and 67 as shown in FIG. 2, is produced by reason of the guide path 83 which is inclined to the perpendicular or, as illustrated in the diagram, curved. In this embodiment, auxiliary carrier has slide guides 81 and 82 at the locations of slide guides 44 and 46, respectively, as shown in FIGS. 1 and 2.

Figure 9:
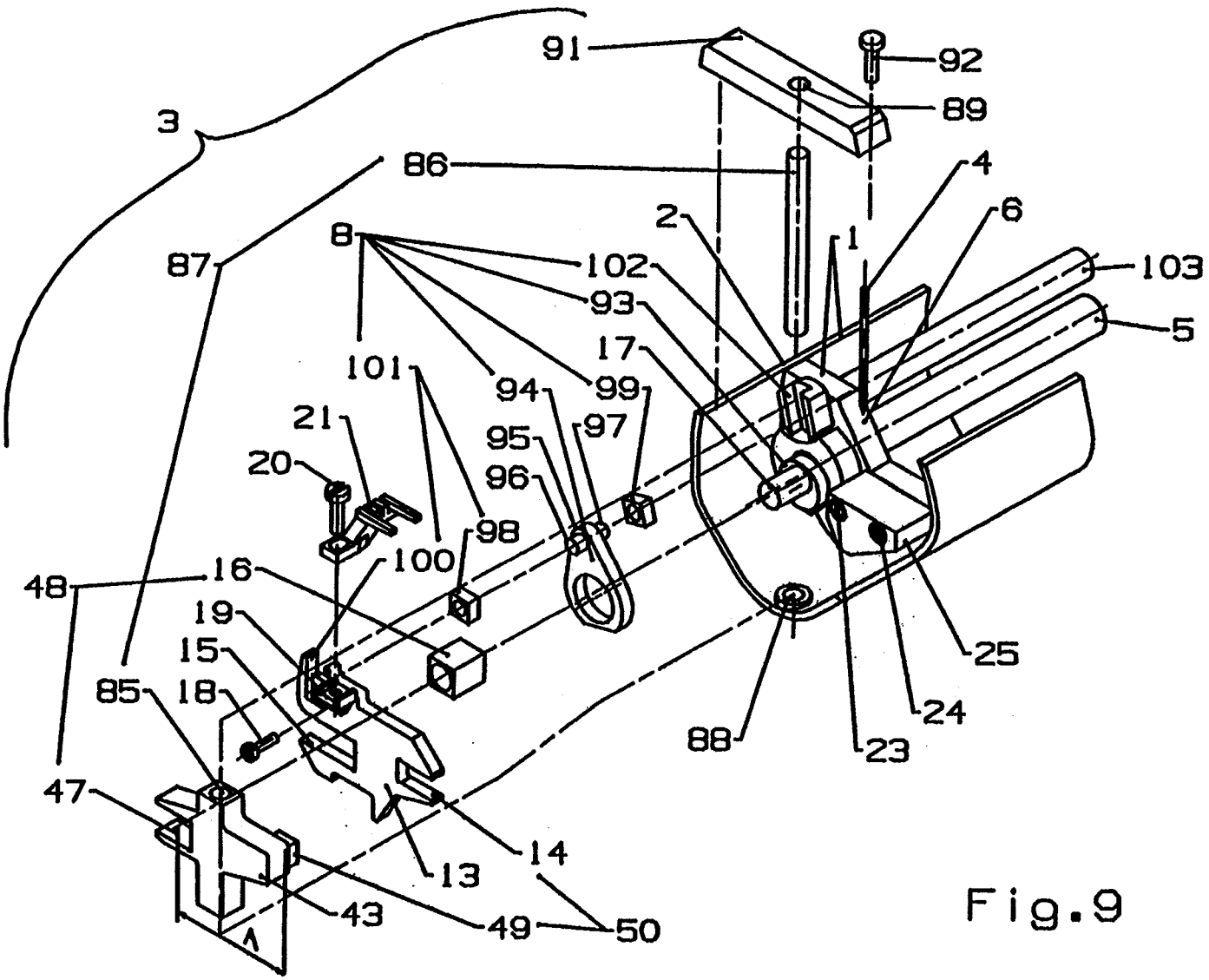
FIG. 9 is an exploded perspective view of a fourth embodiment of workpiece feed device in a partial view of the sewing machine.

FIG. 9 illustrates a fourth embodiment of the invention, which is formed likewise as a simple feed device according to that of FIG. 1. Parts with identical functions to those of FIG. 1 bear identical designations.

The auxiliary carrier 43 has an opening 85 through which passes a guide rod 86 and the guide rod 86 and the opening 85 form a further vertical guide 87. The guide rod 86 is secured to the housing in a mounting eye 88 in the cylinder arm 2 and an opening 89 of a bridge 91 which for its part is attached by a screw 92 to the cylinder arm 2.

The main shaft 5 supports a feed eccentric 93, which is encircled by a connecting rod 94 which sup-ports at its free end 95 pins 96 and 97. The pin 96 is received in a feed slide piece 98 and the pin 97 is received in a sliding block 99. The feed slide piece 98 protrudes into a feed slot 100 of the feed dog carrier 13. The feed slot 100 and the feed slide piece 98 are part of a feed drive connection 101.

The sliding block 99 is guided in a sliding manner in a guide groove 102 which can be adjusted in its inclination and the guide groove 102 is disposed on an adjustable shaft 103. The variable inclination of the guide groove 102 predetermines in a known manner the length of the feed movement of the feed dog 21. The lift components of the connecting rod 94 are suppressed by virtue of the lift slot 100 and the feed slide piece 98 and thus are not effective.

Figure 10:
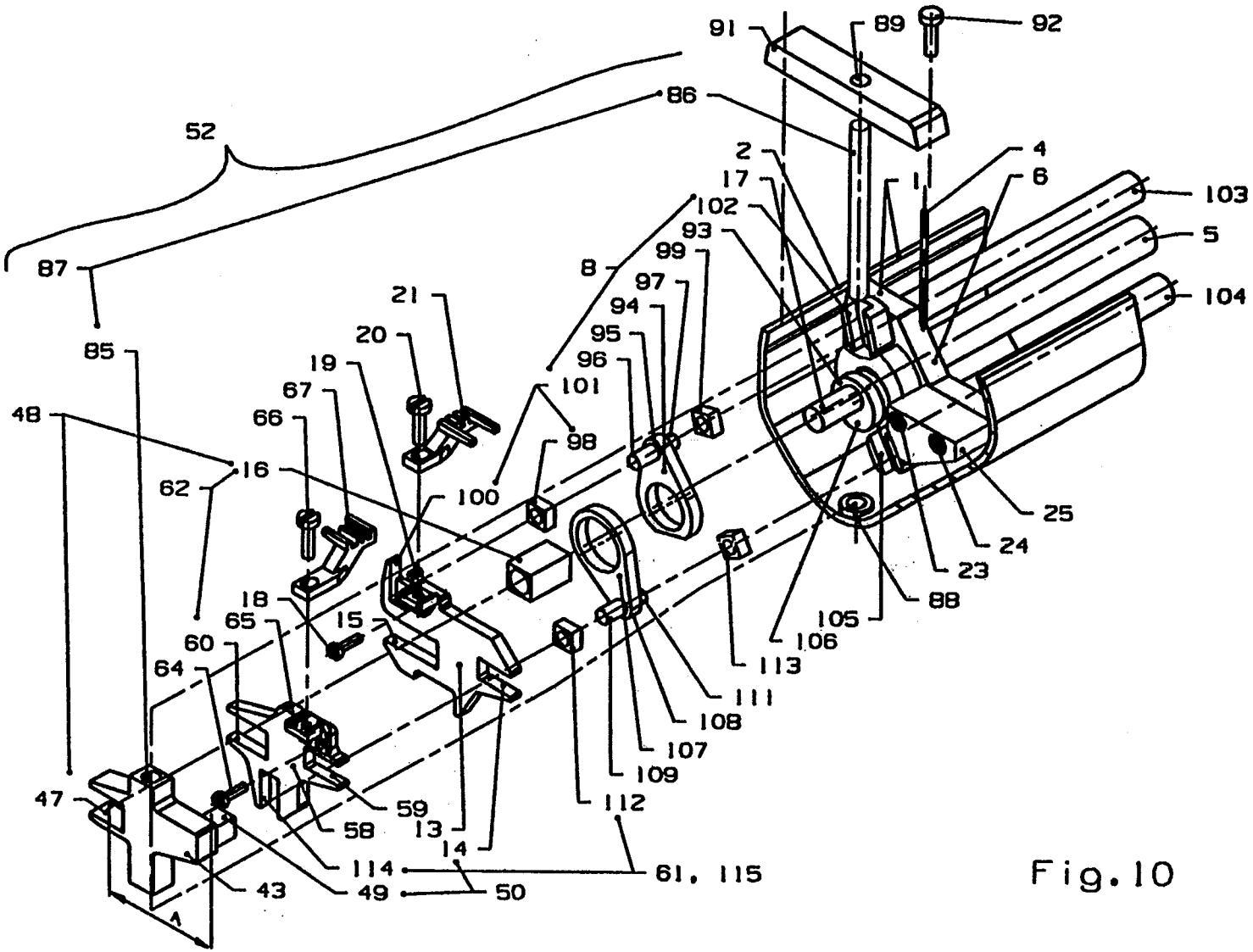
FIG. 10 is an exploded perspective view of a fifth embodiment of workpiece feed device in a partial view of the sewing machine.

FIG. 10 illustrates a fifth embodiment of the invention. Parts with identical functions to those parts of FIGS. 1, 2 and 9 have identical designations. The workpiece feed device 52, which is also referred to as the differential feed device, is illustrated accordingly in FIG. 2.

A further adjustable shaft 104 is mounted in the intermediate plate 6 and supports at one of its ends a further guide groove 105.

The main shaft 5 supports a further feed eccentric 106 for the feed movement of the further feed dog carrier 58. A further connecting rod 107 encircles the lift eccentric 106 and supports at its free lower end 108 pins 109 and 111. The pin 109 is received in a feed slide piece 112 and the pin 111 is received in a sliding bock 113. The feed slide piece 112 protrudes into a feed slot 114 of the further feed dog carrier 58. The feed slot 114 and the feed slide piece 112 are part of the further feed drive 61 and/or of a feed drive connection 115.

The sliding block 113 is guided in a sliding manner in the guide groove 105. The variable inclination of the guide groove 105 predetermines in a known manner the length of the feed movement of the differential feed dog 67. The lift components of the connecting rod 107 are also compensated for here by virtue of the feed slot 114 and the feed slide piece 112 and only the feed components are transmitted to the feed dog carrier 58.

Figure 11:
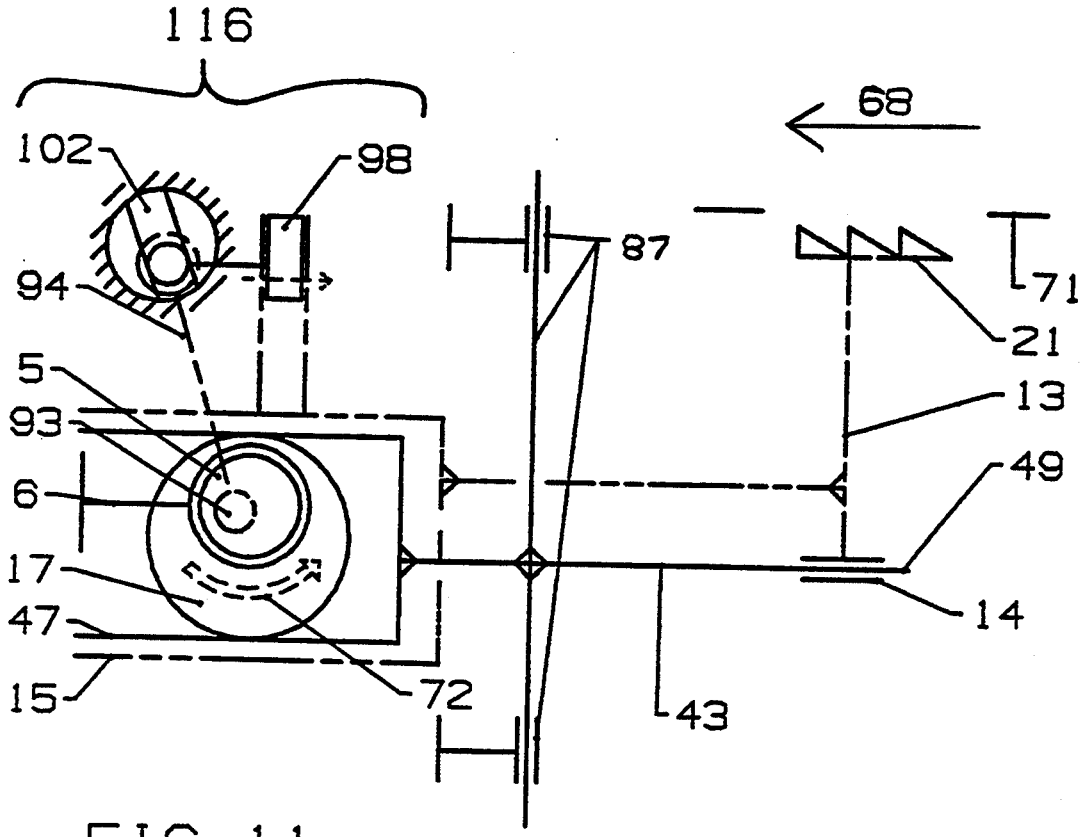
FIG. 11 is a schematic illustration of the fourth workpiece feed device, with the feed dog in the lowered position.
Figure 12:
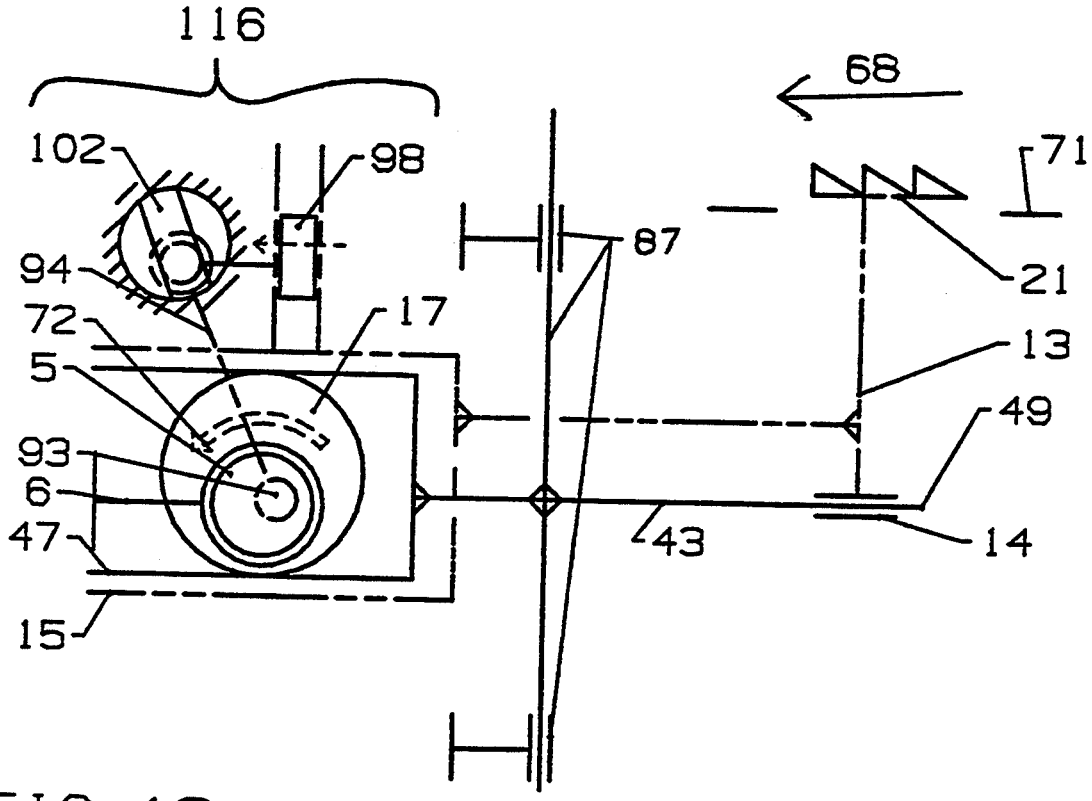
FIG. 12 is a schematic illustration of the fourth workpiece feed device, with the feed dog in the raised position.
Figure 13:
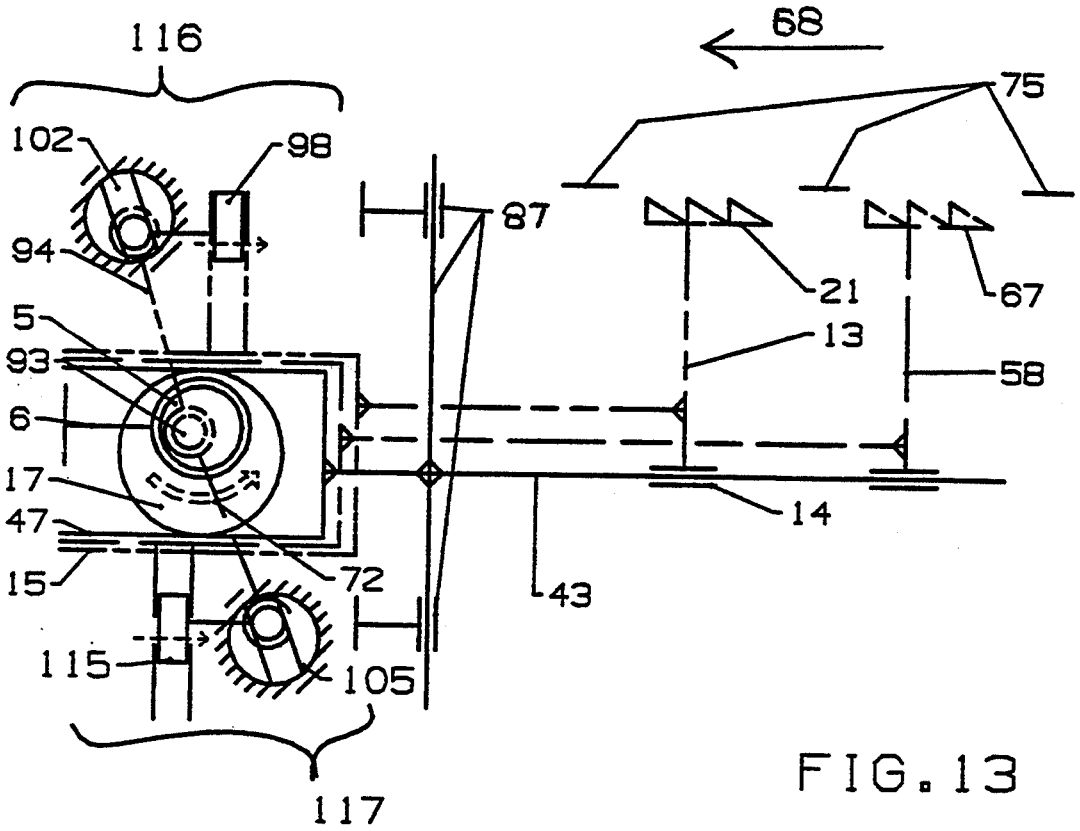
FIG. 13 is a schematic illustration of the fifth workpiece feed device, with the feed dogs in the lowered position.
Figure 14:
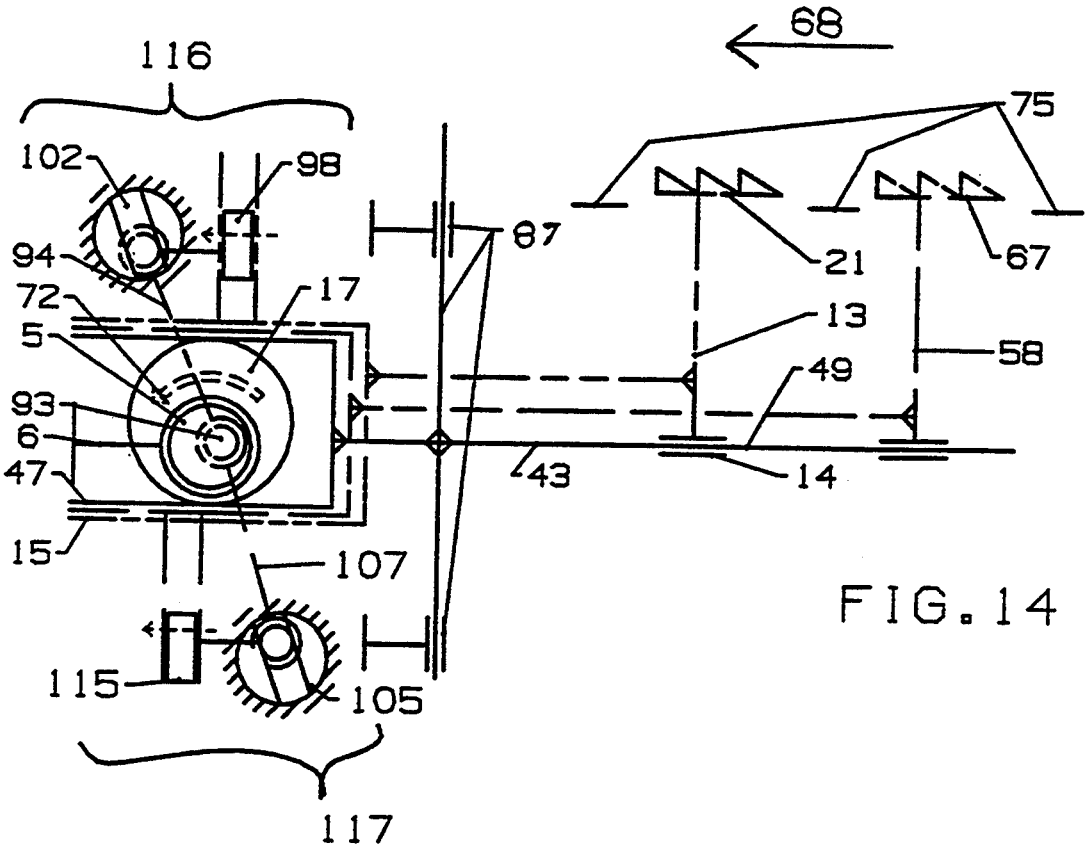
FIG. 14 is a schematic illustration of the fifth workpiece feed device, with the feed dogs in the raised position.

FIGS. 11 to 14 are schematic representations of the plain and differential feed mechanisms illustrated in FIGS. 9 and 10. FIGS. 11 and 13 show feed dogs in the lowered position and FIGS. 12 and 14 show feed dogs in the raised position. In FIGS. 11 to 14, the feed drive is produced by one and/or two known sliding stitch adjusters 116 and 117, such as shown in FIGS. 9 and 10, instead of one and/or two oscillating shafts 7 and 53, such as shown in FIGS. 1 to 3.

The designs of the vertical guides 45, 80 and 87 render it possible to directly influence the lift and/or vertical components of the feed locus 51 of the feed dog 21 and/or of the feed loci of the feed dogs 21 and 67 without being possibly disadvantageously influenced by virtue of a feed drive workpiece feed device. The vertical guides 45, 80 and 87 extend substantially perpendicular to the feed direction, which is illustrated by the arrow 68.

I claim:

1. A sewing machine having a workpiece feed device which performs a lift and feed movement, comprising:

at least one feed dog;

a rotatable main shaft having a lift eccentric;

at least one feed drive;

at least one feed dog carrier drivingly connected to said main shaft and said feed drive, said lift eccentric providing said feed dog carrier with lift movement and said feed drive providing said feed dog carrier with feed movement; and an auxiliary carrier located next to said feed dog carrier and drivingly connected to said main shaft to provide lift movement, said auxiliary carrier being guided by a vertical guide that confines said auxiliary carrier to vertical movement and extends substantially perpendicular to the feed direction, and having a lift that receives a limited component of movement from said main shaft to transmit only lift movement to said feed dog carrier.

2. A sewing machine according to claim 1, in which said feed drive comprises an oscillating shaft, which is drivingly connected to said feed dog carrier.

3. A sewing machine according to claim 1 wherein said feed drive comprises a feed eccentric which is drivingly connected to said feed dog carrier by a connecting rod.

4. A sewing machine according to claim 1 further comprising a second feed dog carrier for receiving a differential feed dog, said second feed dog carrier being driven by said main shaft and said auxiliary carrier.

5. A sewing machine according to claim 4 wherein said sewing machine includes a driven auxiliary shaft and said second feed dog carrier is drivingly connected to said driven auxiliary shaft.

6. A sewing machine according to claim 4 wherein said feed drive comprises a feed eccentric which is drivingly connected to said second feed dog carrier by a connecting rod.

7. A sewing machine according to claim 4 wherein said lift guide of said auxiliary carrier comprises a guide piece which engages a lift opening formed in said second feed dog carrier.

8. A sewing machine according to claim 4 wherein said sewing machine includes a guide plate and a counter guide plate and wherein said feed dog carrier and said second feed dog carrier are located in the axial direction between said guide plate and said counter guide plate so that said guide plate and said counter guide plate function as opposed supports.

9. A sewing machine according to claim 4 wherein said sewing machine includes a counter guide plate and wherein said feed dog carrier and said second feed dog carrier are slidably in the axial direction of said main shaft between said auxiliary carrier and said counter guide plate, so that said auxiliary carrier and said counter guide plate function as opposed supports.

10. A sewing machine according to claim 1 further comprising a lift slide piece which is driven in an eccentric manner by said main shaft and said auxiliary carrier further comprises a lift opening for receiving said lift slide piece.

11. A sewing machine according to claim 1 wherein said lift guide of said auxiliary carrier is a lift guide piece.

12. A sewing machine according to claim 11 wherein said lift guide piece engages a lift opening formed in said feed dog carrier.

13. A sewing machine according to claim 1 wherein said vertical guide has a guide opening for receiving a guide piece.

14. A sewing machine according to claim 1 wherein said vertical guide comprises a plurality of guide openings and a plurality of guide pieces that engage said guide openings.

15. A sewing machine according to claim 14 wherein said sewing machine includes a guide plate located next to said auxiliary carrier and wherein said plurality of guide pieces are attached in an articulated manner to said guide plate.

16. A sewing machine according to claim 1 wherein said sewing machine includes a guide plate and a counter guide plate and wherein said feed dog carrier is located in the axial direction of said main shaft between said guide plate and said counter guide plate such that said guide plate and said counter guide plate function as opposed supports for said feed dog carrier.

17. A sewing machine according to claim 1 wherein said vertical guide comprises an opening formed in said auxiliary carrier, and a guide rod, said guide rod being fixed to said sewing machine and extends into said opening.

18. A sewing machine according to claim 1 wherein said sewing machine includes a counter guide plate and wherein said feed dog carrier is located in the axial direction of said main shaft between said auxiliary carrier and said counter guide plate such that said auxiliary carrier and said counter guide plate function as opposed supports for said feed dog carrier.

19. A sewing machine according to claim 1 wherein said sewing machine includes a cylinder arm and wherein said workpiece feed device is enclosed in said cylinder arm of said sewing machine.

* * * * *

UNITED STATES PATENT AND TRADEMARK OFFICE

CERTIFICATE OF CORRECTION

PATENT NO. : 5,337,689

DATED : August 16, 1994

INVENTOR(S) : Benno V. Tilders

It is certified that error appears in the above-indentified patent and that said Letters Patent is hereby corrected as shown below:

Col. 6, In claim 1, line 4, after "lift" insert --guide--.

Col. 6, In claim 3, line 1, after "1" insert --,--.

Signed and Sealed this

Twenty-fourth Day of October, 1995

*Attest:*

*Attesting Officer*

Bruce Lehman

BRUCE LEHMAN

*Commissioner of Patents and Trademarks*